US005353447A

United States Patent [19]

Gravatt

[11] Patent Number: 5,353,447

[45] Date of Patent: Oct. 11, 1994

[54] ROTATING HYDROTHERAPY JET WITH ADJUSTABLE OFFSET OUTLET NOZZLE

[75] Inventor: Eugene M. Gravatt, Valencia, Calif.

[73] Assignee: B&S Plastics, Inc., Oxnard, Calif.

[21] Appl. No.: 197,616

[22] Filed: Feb. 17, 1994

Related U.S. Application Data

[63] Continuation-in-part of Ser. No. 970,638, Nov. 2, 1992, abandoned.

[51] Int. Cl.[5] ..... A61H 33/00

[52] U.S. Cl. ..... 4/541.6; 239/587.1

[58] Field of Search ..... 4/541.1, 541.3, 541.4, 4/541.6; 239/416.4, 416.5, 417.3, 423, 424, 428.5, 587.1

[56] References Cited

U.S. PATENT DOCUMENTS

| | | | |
|---|---|---|---|
| 3,868,949 | 3/1975 | Arneson | 128/66 |
| 4,220,145 | 9/1980 | Stamp et al. | 4/541.6 |
| 4,339,833 | 7/1982 | Mandell | 4/541.6 |
| 4,486,907 | 12/1984 | Carter | 4/490 |
| 4,508,665 | 4/1985 | Spinnett | 261/93 |
| 4,523,340 | 6/1985 | Watkins | 4/541.4 |
| 4,692,950 | 9/1987 | Henkin et al. | 4/541.6 |
| 4,715,071 | 12/1987 | Henkin et al. | 4/541.6 |
| 5,003,646 | 4/1991 | Stamp et al. | 4/541.6 |
| 5,014,372 | 5/1991 | Thrasher et al. | 4/541.6 |
| 5,271,561 | 12/1993 | Tobias et al. | 4/541.6 X |

FOREIGN PATENT DOCUMENTS 3820349 12/1989 Fed. Rep. of Germany ..... 4/541.6

OTHER PUBLICATIONS

Waterway Plastics blueprints for Part Nos. 210—2260, 210—2850, 210—3260 and 210—3750, on sale prior to Nov. 2, 1991.

*Primary Examiner*—Robert M. Fetsuga
*Attorney, Agent, or Firm*—Koppel & Jacobs

[57] ABSTRACT

An adjustable rotating hydrotherapy jet has a rotatable support structure for a jet outlet nozzle that holds the outlet nozzle with its axis offset from the rotation axis, and at a non-intersecting and non-zero angle thereto. The jet flow through the outlet nozzle thus imparts a turning moment to the support structure, causing it to rotate along with the nozzle. The outlet is preferably provided as an eyeball-type fitting, with the eyeball adjustable over a range of angles relative to its support structure to allow for a selection of the jet's angle and rotational speed; this preferably includes an adjustment position at which the eyeball axis is parallel to the rotational axis and the jet does not rotate. A tab in the eyeball's support structure preferably lodges in a track in the eyeball member to restrict the eyeball adjustment to a plane that develops the maximum rotational thrust.

26 Claims, 4 Drawing Sheets

ROTATING HYDROTHERAPY JET WITH ADJUSTABLE OFFSET OUTLET NOZZLE

RELATED APPLICATION

This application is a continuation-in-part of application Ser. No. 07/970,638, filed Nov. 2, 1992, abandoned.

BACKGROUND OF THE INVENTION

1. Field of the Invention

This invention relates to rotating hydrotherapy jets.

2. Description of the Related Art

Various hydrotherapy jets have been developed in the past, for use in spas, hot tubs and bathtubs, that discharge an aerated stream of water in a rotating pattern. Such jets have been found to produce a pleasing massaging effect for many users, and have become quite popular. Representative rotating jets are disclosed in U.S. Pat. Nos. 4,763,367, 4,715,071, 4,692,950, 4,523,340, 4,339,833, 4,220,145 and 3,868,949. B & S Plastics, Inc., the assignee of the present invention, has also produced rotating jets designated as Model Nos. 213-1260, 213-1270, 213-2760 and 213-3760.

The prior rotating jets generally employ either a long discharge tube with an in-line inlet that receives a jet flow from a venturi nozzle and a remote outlet that is off-axis and follows a track around an outlet plate, or a rotating discharge plug that includes an angled jet discharge conduit and is held in place a retaining pin at its forward end.

Such designs require additional parts for the rotation feature that obstruct or restrict the output flow from the jet, and also present an appreciable resistance to rotation that further reduces the output rate. In addition, they cannot be switched between rotating and non-rotating modes, and neither the angle at which the water/air flow is injected into the spa or the rotational speed can be adjusted. These types of adjustment features would be highly desirable, but are incompatible with existing designs.

SUMMARY OF THE INVENTION

The present invention seeks to provide a rotatable hydrotherapy jet that is simple in design and can be easily fabricated using conventional molding techniques, provides easy user-operated controls over the rotational speed and output flow angle, plus a non-rotational option, and achieves a less obstructed flow and freer rotation than prior rotatable jets.

These goals are achieved with a new jet that includes a housing, a water inlet to the housing, a water nozzle within the housing that forms water flowing through the inlet into a jet, an outlet nozzle, and a support structure that holds the outlet nozzle downstream from the water nozzle to receive the jet flow and discharge the flow along an outlet axis. The support structure is rotatable about a rotation axis, which preferably is coaxial with the water nozzle axis. It holds the outlet nozzle so that the nozzle can be oriented with the outlet axis offset from, and at a non-intersecting and non-zero angle to, the rotation axis. In this manner the jet flow through the outlet nozzle imparts a turning moment to the support structure, causing it to rotate along with the outlet nozzle and produce a rotating discharge from the jet.

In the preferred embodiment the orientation of the outlet nozzle is adjustable so as to adjust the angle between the outlet and rotation axes, and thereby provide user control over both the outlet flow angle and the speed of rotation. The angular adjustment range preferably includes a setting at which the outlet nozzle axis is parallel to the rotation axis, and thus adds a non-rotational mode.

At the non-rotational orientation, the outlet nozzle axis is in a substantially common plane with the rotation axis. The outlet nozzle is preferably adjustable from its non-rotation setting along a plane that is substantially perpendicular to the above-mentioned common plane, thus providing for maximum rotational thrust. The outlet nozzle is restricted to this adjustment plane by fabricating it on an eyeball-type outlet that includes a ball portion which is captured in a rotatable socket. A tab extends from the socket into a track formed in the surface of the ball portion, preventing the eyeball outlet from rotating out of the desired adjustment plane.

The jet also allows for an enhanced intake of air into the water stream between the water and outlet nozzles, and a water flow adjustment mechanism is provided that is controlled without having to touch either the outlet nozzle or the support structure. The support structure is preferably positioned within a cavity in the housing, with an ring at the rear of the support structure rotatably mounted on a cylindrical stator that extends up from the base of the cavity and has an opening through which the water jet flows. A ball bearing track is preferably provided between the stator and support structure ring to reduce rotational friction.

Further features and advantages of the invention will be apparent to those skilled in the art from the following detailed description, taken together with the accompanying drawings.

DETAILED DESCRIPTION OF THE INVENTION

Figure 1:
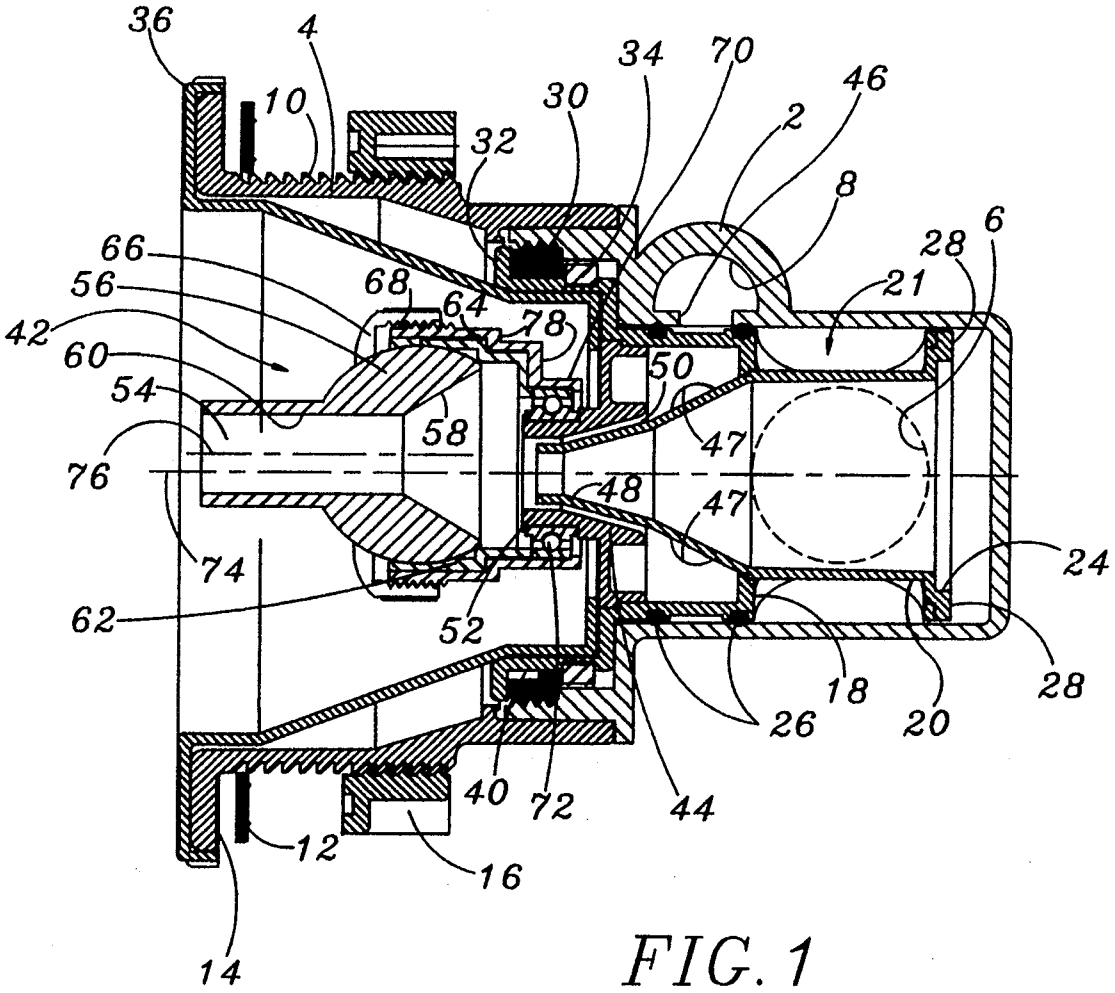
FIG. 1 is a sectional view of a rotatable hydrotherapy jet in accordance with the invention.
Figure 2:
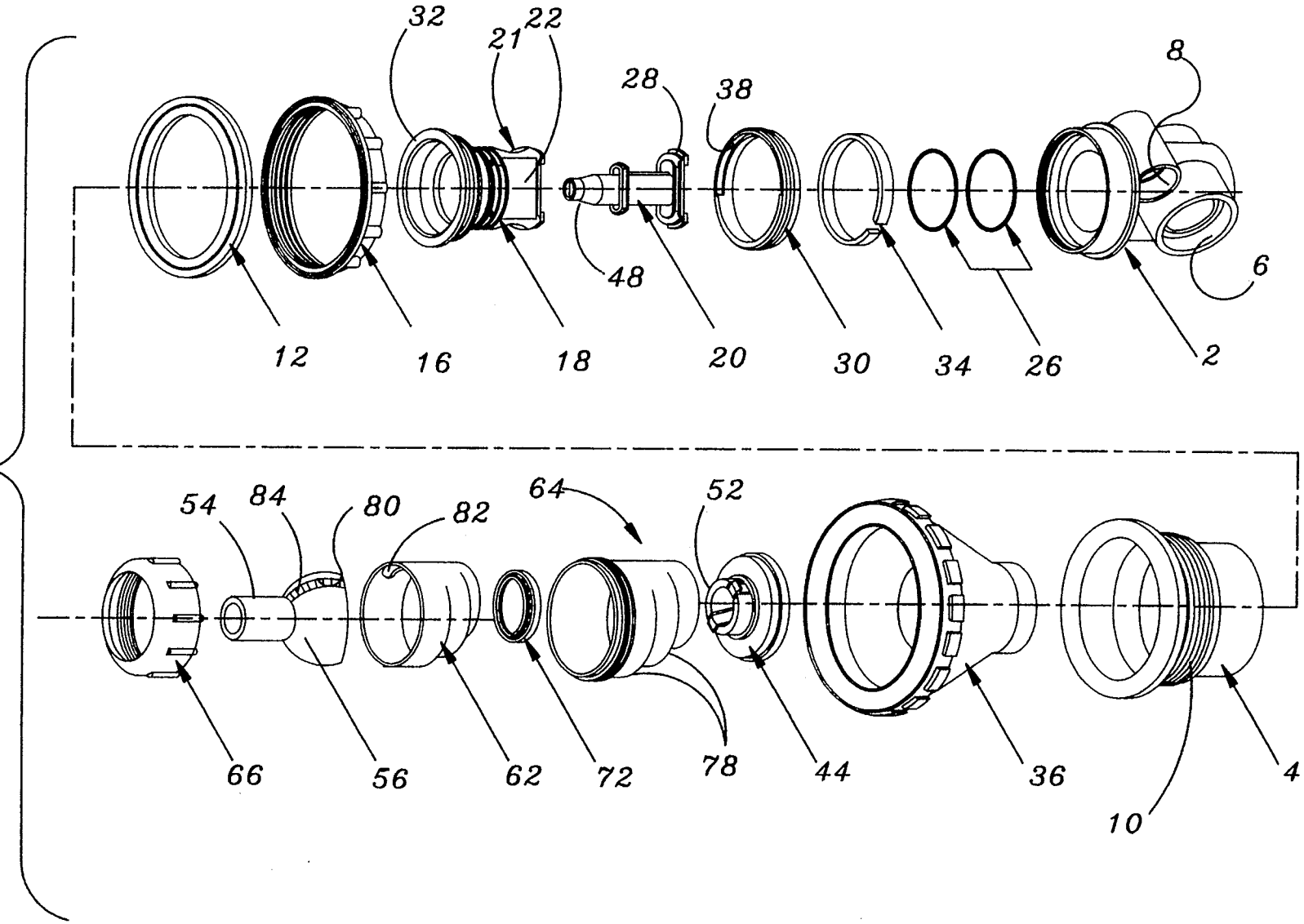
FIG. 2 is an exploded perspective view of the jet shown in FIG. 1.

A rotational hydrotherapy jet that is constructed in accordance with the invention is shown in FIGS. 1 and 2. The jet is enclosed within a housing that consists of a rear body portion 2 that mates with a front body portion 4. The rear body portion includes water and air conduits 6 and 8 that allow for a flow of water and air through the rear of the jet, transverse to the jet axis. The water and air conduits include sockets at either end to receive tubing from adjacent jets in a common water and air supply system for a series of jets. The front body portion 4 includes an exterior threading 10, with a gasket 12 adjacent a front flange 14 at the forward end of the threading, and a nut 16 screwed onto the threading to the rear of the gasket. The jet is held in place, protruding through an opening in the wall of a spa or tub, by sandwiching the spa or tub wall surrounding the opening between the gasket 12 and nut 16, and tightening the nut.

A diverter element 18 is positioned within the rear portion of the housing, and retains an interior water nozzle 20. The diverter can be rotated, along with its held water nozzle, through an arc of about 90° to adjust the volume of water discharged out from the jet. For this purpose it includes a cylindrical bypass opening 21 towards its rear end that is bounded by a pair of opposed side walls 22 with flat exterior surfaces (see FIG. 2). The nozzle width (into the page in FIGS. 1 and 2) is less than the diameter of the bypass opening 21, leaving space on either side of the nozzle for water to flow through the opening. When the diverter is positioned at one end of its rotational limit, as shown in FIG. 1, the walls 22 are perpendicular to the water conduit 6, causing water entering through the conduit to deflect rearward and to enter the water nozzle 20 through an opening 24 at the back of the nozzle. When the diverter 18 is rotated 90° the bypass opening 21 is aligned with the interior of the water conduit 6, and water entering from one end of the conduit continues to flow through the opening 21 (around both sides of the nozzle 20 that extends across the opening) and out the other end of the water conduit, without being discharged through the jet. Intermediate levels of water flow out of the jet can be established by rotating the diverter to intermediate positions between the limits of its rotation. A further description of the flow control mechanism is provided below in connection with FIGS. 5 and 6.

A pair of O-rings 26 are lodged in grooves in the diverter's exterior surface and bear against the inner housing wall to facilitate the diverter's rotation, and also to restrict air entering through air conduit 8 to a desired path through the jet. The nozzle includes a pair of opposed flange sections 28 at its rear that are seated on the rear surface of the diverter.

The diverter is held within the housing by a retainer ring 30, which is secured just to the rear of a forward diverter flange 32 by means of a snap ring 34. The rotational position of the diverter is controlled by means of a face plate 36 that overlaps the front end of the jet housing, and extends back into the interior of the housing to engage the diverter along a broad surface contact. The face plate 36 can be easily grasped by the user and rotated to adjust the water flow. The 90° rotational limit is set by means of a keyway 38 in the interior surface of the retainer ring 30, and a mating key 40 on the exterior of the diverter.

The novel structure that provides for an improved rotational output from the jet will now be described. The forward portion of the jet housing and the face plate 36 form a large cavity 42 which opens to the front of the jet, and the rotating elements of the jet are located within this cavity. An air nozzle 44 spans the forward end of the diverter 18, and directs a flow of air that enters the jet through an opening 46 below the air conduit 8. The air flows around the exterior of the diverter 18 which is slightly recessed in this area for this purpose, and into the interior of the diverter through openings 47. The water nozzle 20 includes a long tapered orifice 48 that accelerates the water flowing through the nozzle into a venturi jet. The interior surface of the air nozzle 44 is slightly offset from the exterior of the water orifice 48, leaving a passageway 50 through which air can flow to the forward end of the water nozzle. At that location the air is entrained into the water jet due to the venturi action, causing a desirable water/air mixture to be emitted from the jet.

The air nozzle 44 includes a boss 52 that extends into the cavity 42 and acts as a stator for the rotating outlet. An outlet nozzle is preferably provided as the tubular outlet 54 of an eyeball-type fitting. This fitting includes a ball portion 56 that is integrally formed with the outlet tube 54, with a large opening 58 formed at the rear of the ball portion and tapering to a cylindrical opening 60 through the outlet tube 54. The eyeball piece is rotatably lodged in a socket that consists of a wear ring 62, and a mounting support member 64 within which the wear ring 62 is captured. The eyeball outlet is held in place against the wear ring 62 by means of a threaded retainer 66 that screws over an exterior threading 68 at the forward end of the mounting support member 64, with the eyeball piece held in place between the wear ring 62 and retainer 66.

A ring 70 is formed at the rear of the mounting support member 64 and is positioned around the stator 52, separated from the stator by a ball bearing 72 that allows for a very low friction rotation of the mounting support member around the stator.

A critical aspect of the invention is the geometric relationship between the eyeball piece and the rest of the jet. As best seen in FIG. 1, the stator 52 and ball bearing 72 provide a rotation axis 74 for the mounting support member 64. This rotation axis is preferably coaxial with the axis of the water nozzle 20, although if desired the water nozzle can be offset somewhat. However, the eyeball outlet tube 54 has an axis 76 that is offset from, not coincident with, the rotation axis 74. This is accomplished by providing the mounting support member 64 and wear ring 62 with a series of steps 78 on one lateral side but not on the other. When the eyeball is positioned with its axis 76 parallel to the rotation axis 74, as illustrated in FIG. 1, the two axes 76 and 74 lie in a common plane (the plane of the page), and are parallel but offset from each other.

With the eyeball positioned as shown in FIG. 1, the water/air flow through its outlet tube 54 will not produce any rotational thrust around the ball bearing 72. However, if the position of the eyeball outlet is adjusted by rotating it within its socket so that it is at a non-zero angle to the common plane formed by the rotation axis 74 and the parallel eyeball axis 76 prior to its rotation (out of the page as seen in FIG. 1), the jet flow through the eyeball outlet will produce a counter-thrust that has a component directed into the page of FIG. 1. Since this thrust component is offset from and perpendicular to the rotation axis 74, it produces a turning moment that causes the eyeball outlet and its mounting structure to rotate around the ball bearing 72. This turning moment is maintained as the outlet rotates about the rotational axis, so that the rotation continues for as long as the eyeball is kept in the same position with respect to its mounting structure and water continues to flow out through the jet. The eyeball position can be easily adjusted by first rotating the face plate 36 to shut off the flow of water through the jet, and then restarting the water flow after the adjustment has been made.

So long as the eyeball is not rotated to a position at which its axis 76 intersects the rotation axis 74, the jet flow will produce a counter-thrust that has a component which causes the eyeball structure to rotate. However, a maximum rotational force is obtained when the eyeball is moved in a direction perpendicular to the common plane of the eyeball and rotation axes 76 and 74 shown in FIG. 1. The eyeball is limited to this mode of adjustment in the preferred embodiment by providing a recessed track 80 along its wall portion 56 parallel to the eyeball axis, and a mating tab 82 that extends forward from the wear ring 62 and lodges in the track. This allows the eyeball to be rotated with respect to its support structure only along the path defined by the track 80 and tab 82. The tab is positioned around the periphery of the wear ring 62 90° from the center of the offset steps 78, thus assuring that the eyeball adjustment occurs along a plane that is perpendicular to its offset from the rotation axis 74.

Figure 3:
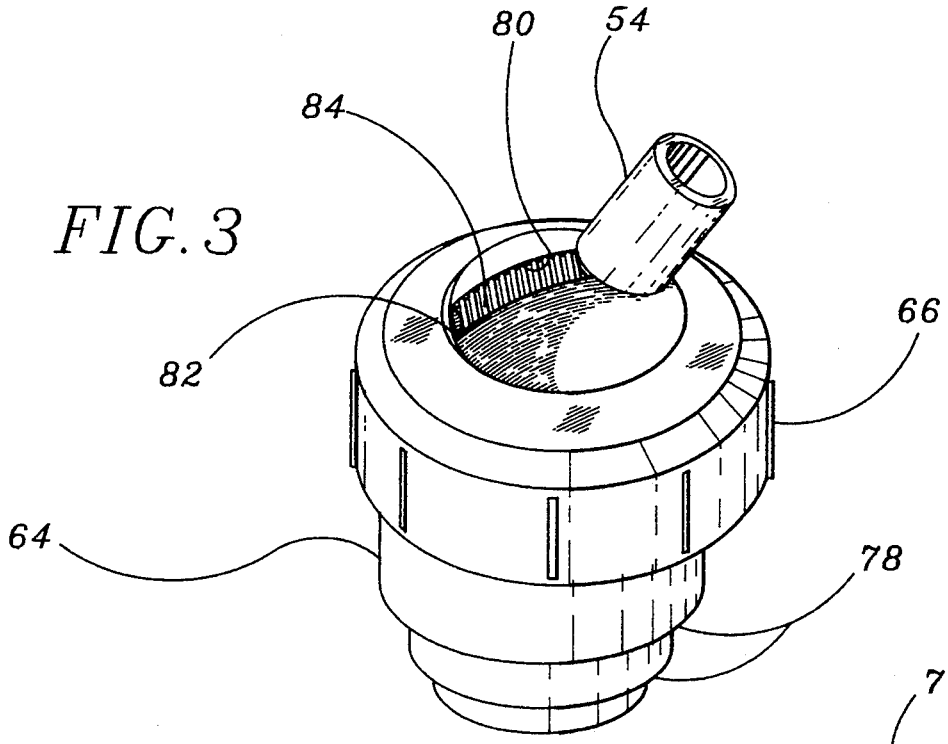
FIG. 3 is a perspective view showing the angular outlet adjustment.

The eyeball outlet and its associated support structure are shown in FIG. 2 rotated 90° from their position in FIG. 1, and thus the track 80 and tab 82 do not appear in FIG. 1. The track 80 preferably includes a series of detents 84 along its base, with the tab 82 being stiffly flexible to ride over the detents when the eyeball outlet is adjusted, and to lodge between detents at the conclusion of an adjustment to retain the outlet nozzle in its adjusted position. FIG. 3 shows the eyeball outlet assembled in its support structure, with its adjustment guided by the track 80 and tab 82.

Figure 4A:
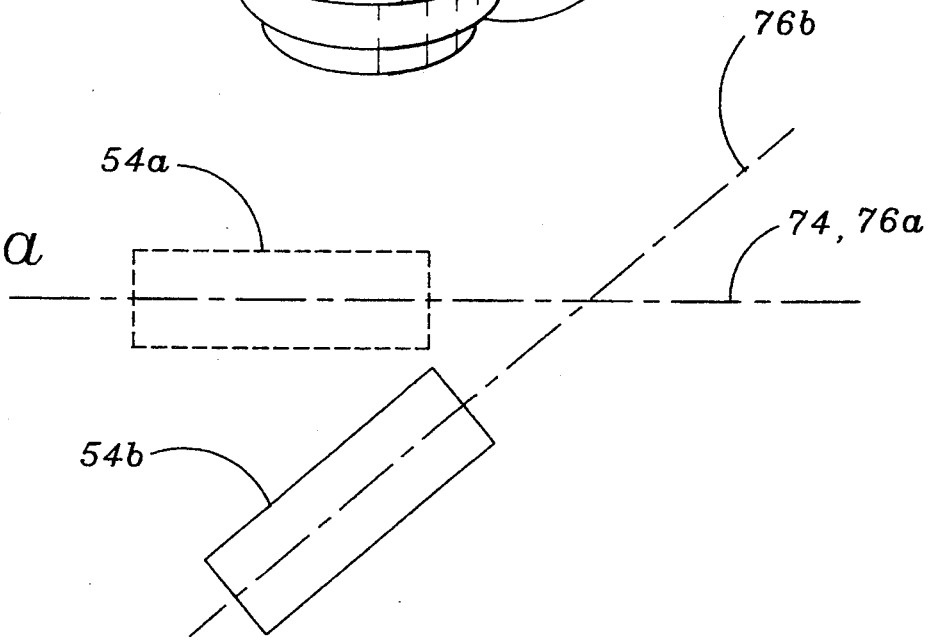
FIGS. 4*a* and 4*b* are respectively illustrative plan and elevational diagrams illustrating the different orientations for the outlet nozzle employed in the invention.
Figure 4B:
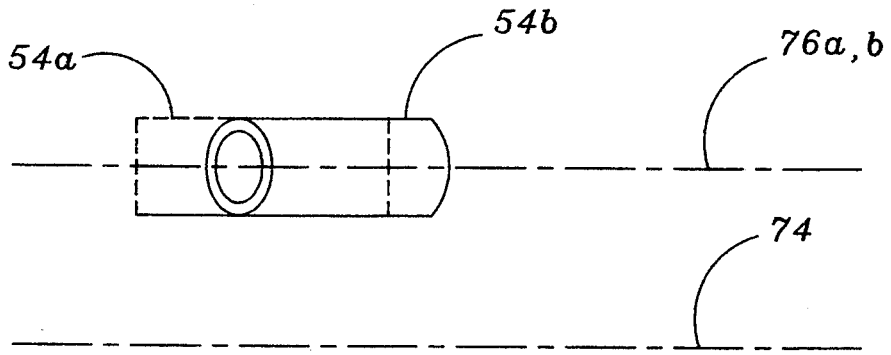

FIGS. 4*a* and 4*b* are diagrammatic views which further illustrate the preferred relative orientation between the jet's outlet nozzle and rotation axis. In these figures only the eyeball outlet nozzle 54, its axis 76 and the rotation axis 74 are shown. FIG. 4*a* is a plan view, looking down at the adjustment plane for the eyeball nozzle, while FIG. 4*b* is an elevation view in which the eyeball's adjustment plane is shown above the rotation axis 74. In its position 54*a* the outlet nozzle's axis 76*a* is parallel to the rotation axis 74 (the position shown in FIG. 1), and the jet does not rotate. When the outlet nozzle is adjusted to the position 54*b*, its axis 76*b* is no longer parallel to the rotation axis 74, but it still does not intersect the rotation axis. A rotational moment is thus developed that causes the jet to rotate about axis 74.

Maximum rotation will generally result when the outlet nozzle is rotated about 30° from the rotation axis. However, the mounting structure and eyeball can provide for a somewhat greater rotational range to provide the user with an extra degree of choice in the rotating massage effect that is provided by the jet.

It can be seen that there are no obstructions to the outward flow of water from the eyeball outlet into the spa or bathtub. The ability to easily adjust the position of the eyeball outlet relative to its support structure allows the user to select whatever rotational speed and jet angle are most pleasing to her or him, and also to select a non-rotating operation if desired.

Figure 5:
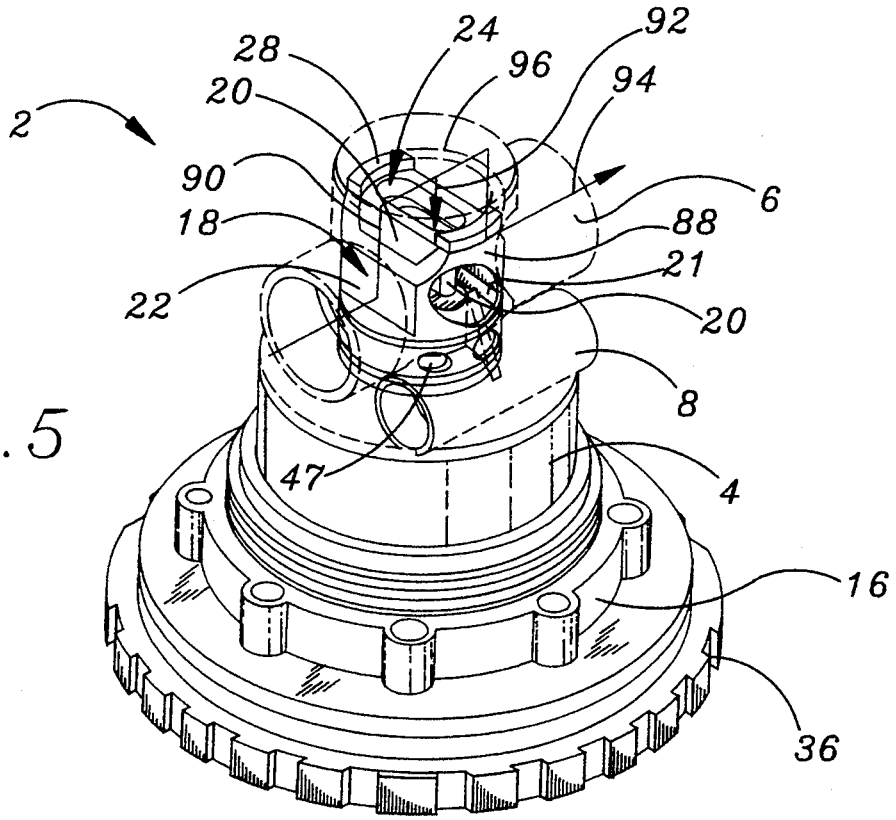
FIG. 5 is a perspective view of the mechanism for controlling the flow of water through the jet, with the mechanism adjusted to produce a jet discharge.
Figure 6:
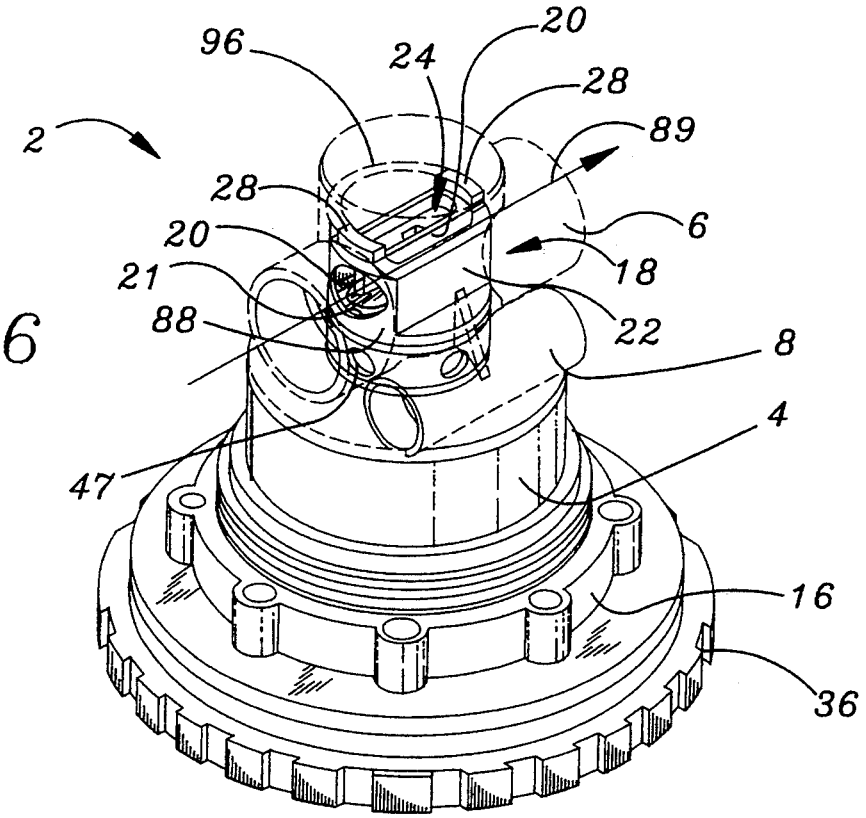
FIG. 6 is a perspective view similar to FIG. 5, but with the flow control mechanism rotated 90° to prevent a jet discharge.

FIGS. 5 and 6 present a perspective view of the mechanism which controls the volume of water discharge from the jet. The rear body portion 2, water conduit 6 and air conduit 8 are shown in phantom lines so that the diverter 18 can be seen.

The bypass opening 21 in diverter 18 permits water flowing in from one end of the water conduit to continue flowing out the other end of the conduit when the diverter is rotated to align the opening 21 with the water conduit, as in FIG. 6. The diverter face 88 through which the opening 21 is formed is rounded to match the inner diameter of the rear body portion 2, and has a sufficiently large area to prevent water from flowing around the sides of the diverter when it is in the position of FIG. 6. Thus, in FIG. 6 all of the water that enters the water conduit 6 continues on through the bypass opening 21 and exits the jet through the opposite end of the conduit 6, with no water discharged through the jet. This is indicated by the water flow arrow 89.

The nozzle 20 extends from the rear of the diverter 18, through the center of the diverter's bypass opening 21, and into the discharge portion of the jet (not shown), where it is tapered to the discharge orifice 48 shown in FIG. 1. The elongate opening 24 at the rear of the nozzle receives water when the diverter is rotated to the position shown in FIG. 5. The nozzle is narrow enough that it occupies only the central portion of the diverter bypass opening 21, leaving a clearance for water to flow around both sides of the nozzle in the position of FIG. 6.

When a full jet discharge is desired, the face plate 36 is adjusted to rotate the diverter to the FIG. 5 position. In this position the flow of water from the inlet water conduit 6 is diverted by the diverter side wall 22 so that it flows towards the rear of the diverter, as indicated by arrow 90. Some of the water enters the nozzle through its rear opening 24, as indicated by arrow 92; the rest of the water continues flowing past the rear of the nozzle and diverter and out through the opposite end of the water conduit 6 to the remaining jets in the spa, as indicated by arrow 94. (The last jet in line will have the outlets from its water and air conduits capped, and for this jet there will be no water outflow 94).

Intermediate water discharges between fully on and fully off are established by rotating the diverter to intermediate positions between those shown in FIGS. 5 and 6. In the intermediate positions a portion of the inlet water flows through the bypass opening 21 to bypass the nozzle, and the remainder is diverted to the area of the nozzle opening 24. Air is admitted into the jet discharge through the openings 47 in the exterior diverter wall for all of the diverter orientations.

If it is desired to direct all of the inlet water flow into a single powerful jet discharge, rather than leaving some for downstream jets, the flange sections 28 at the rear of the nozzle, and also the curvature of the diverter walls 88, can be extended on one side as indicated by phantom lines 96 in a total arc somewhat greater than 180°. Since the exterior surface of this extension slides against the inner cylindrical wall of the jet's rear body portion, essentially no water can flow past the rear of the jet and out the water conduit in the position of FIG. 5. A greater jet discharge is thus achieved, but at the cost of cutting off downstream jets. If downstream jet operation is also desired with this configuration, the upstream jet would be rotated to an intermediate position between FIGS. 5 and 6 to discharge some of the water through the jet, and transmit the rest of the water via bypass opening 21 to the downstream jet.

While particular embodiments of the invention have been shown and described, numerous variations and additional embodiments will occur to those skilled in the art. Accordingly, it is intended that the invention be limited only in terms of the appended claims.

I claim:

1. A rotatable hydrotherapy jet, comprising:

a jet housing, a water inlet to said housing, a tapered water nozzle within said housing for forming water flowing through said inlet into a jet, a single outlet nozzle having an entrance port that is generally in-line with said water nozzle for receiving a water jet directly from said water nozzle, and a support structure for holding said outlet nozzle downstream from said water nozzle to receive said jet and discharge it along an outlet axis, said support structure being mounted to said housing, rotatable relative to the housing about a rotation axis and holding said outlet nozzle so that it can be oriented with its outlet axis offset from and at a non-intersecting and non-parallel orientation with respect to said rotation axis, such that the flow of said jet through the outlet nozzle at said non-intersecting and non-parallel axis orientation imparts a turning moment to said support structure, causing it to rotate along with said outlet nozzle.

2. The rotatable hydrotherapy jet of claim 1, wherein said support structure includes means for adjusting the orientation of said outlet nozzle with respect to said support structure and thereby adjusting the orientation of said outlet axis relative to the orientation of said rotation axis.

3. The rotatable hydrotherapy jet of claim 2, wherein the orientation of said outlet nozzle is adjustable over a range of relative outlet-rotation axis orientations that includes a parallel orientation at which said support structure does not rotate.

4. The rotatable hydrotherapy jet of claim 3, wherein said outlet axis at said parallel orientation adjustment is in a substantially common plane with said rotation axis, and said outlet nozzle is adjustable along a plane that is substantially perpendicular to said common plane.

5. The rotatable hydrotherapy jet of claim 2, wherein said support structure includes means for restricting the adjustment of said outlet nozzle to an adjustment plane that is substantially parallel to but offset from said rotation axis.

6. The rotatable hydrotherapy jet of claim 5, wherein said support structure comprises the ball portion of an eyeball-type outlet and a rotatable socket capturing said ball portion, said outlet nozzle comprises a tubular outlet from said ball portion with said socket and ball portion including mutually engaging means restricting the adjustment of said ball portion to said adjustment plane for said tubular water outlet.

7. The rotatable hydrotherapy jet of claim 6, said mutually engaging means comprising a recessed track along said ball portion and a tab that extends from said socket into said track.

8. The rotatable hydrotherapy jet of claim 7, said track including a series of detents, and said tab being stiffly flexible to ride over said detents during adjustment of the eyeball-type outlet, and to lodge between detents at the conclusion of an adjustment to retain the outlet nozzle at its adjusted position.

9. The rotatable hydrotherapy jet of claim 1, said outlet nozzle comprising a straight tubular nozzle.

10. The rotatable hydrotherapy jet of claim 1, wherein said water nozzle has an axis that is coaxial with said rotation axis.

11. A rotatable hydrotherapy jet, comprising:

a jet housing, a water inlet to said housing, a water nozzle within said housing for forming water flowing through said inlet into a jet, an outlet nozzle, a support structure for holding said outlet nozzle downstream from said water nozzle to receive said jet and discharge it along an outlet axis, said support structure being mounted to said housing, rotatable relative to the housing about a rotation axis and holding said outlet nozzle so that it can be oriented with its outlet axis offset from and at a non-intersecting and non-parallel orientation with respect to said rotation axis, such that the flow of said jet through the outlet nozzle at said non-intersecting and non-parallel axis orientation imparts a turning moment to said support structure, causing it to rotate along with said outlet nozzle, and means for introducing an air flow into said water jet between said water and outlet nozzles.

12. A rotatable hydrotherapy jet, comprising:

a jet housing, a water inlet to said housing, a water nozzle within said housing for forming water flowing through said inlet into a jet, an outlet nozzle, and a support structure for holding said outlet nozzle downstream from said water nozzle to receive said jet and discharge it along an outlet axis, said support structure being mounted to said housing, rotatable relative to the housing about a rotation axis and holding said outlet nozzle so that it can be oriented with its outlet axis offset from and at a non-intersecting and non-parallel orientation with respect to said rotation axis, such that the flow of said jet through the outlet nozzle at said non-intersecting and non-parallel axis orientation imparts a turning moment to said support structure, causing it to rotate along with said outlet nozzle, said housing including a cavity for receiving said support structure, said cavity including a cylindrical stator extending up from its base with an opening through the stator for said water jet, with said support structure rotatably mounted to said stator.

13. The rotatable hydrotherapy jet of claim 12, further comprising a ball bearing track between said stator and said support structure ring.

14. The rotatable hydrotherapy jet of claim 12, wherein said housing cavity is cylindrical and coaxial with said rotation axis and stator, said support structure comprises the ball portion of an eyeball-type outlet and a socket member that captures said ball portion at its forward end at an offset from said rotation axis, and said outlet nozzle comprises a tubular outlet from said ball portion.

15. A rotatable hydrotherapy jet, comprising:

a jet housing, a water inlet into said housing, a tapered water nozzle within said housing for forming water flowing through said inlet into a jet along a water nozzle axis, a single outlet nozzle having an outlet nozzle axis, and an entrance port that is generally in-line with said water nozzle for receiving a water jet directly from said water nozzle, and a support structure that is mounted to and rotatable relative to said housing for holding said outlet nozzle downstream from said water nozzle to receive said jet, with the outlet nozzle axis offset from and at a non-intersecting and non-parallel orientation with respect to the water nozzle axis, such that the flow of said jet through the outlet nozzle at said non-intersecting and non-parallel orientation imparts a turning moment to said support structure, causing it to rotate along with said outlet nozzle.

16. The rotatable hydrotherapy jet of claim 15, wherein said support structure includes means for adjusting the orientation of said outlet nozzle axis relative to the orientation of said water nozzle axis.

17. The rotatable hydrotherapy jet of claim 16, wherein said outlet nozzle is adjustable over a range of orientations between said outlet nozzle and water nozzle axes that includes a parallel orientation at which said support structure does not rotate.

18. The rotatable hydrotherapy jet of claim 17, wherein the axis of said outlet nozzle at said parallel orientation adjustment is in a substantially common plane with said water nozzle axis, and said outlet nozzle is adjustable along a plane that is substantially perpendicular to said common plane.

19. The rotatable hydrotherapy jet of claim 16, wherein said support structure includes means for restricting the adjustment of said outlet nozzle to an adjustment plane that is substantially parallel to but offset from said water nozzle axis.

20. The rotatable hydrotherapy jet of claim 19, wherein said support structure comprises the ball portion of an eyeball-type outlet and a rotatable socket capturing said ball portion, said outlet nozzle comprises a tubular outlet from said ball portion with said socket and ball portion including mutually engaging means restricting the adjustment of said ball portion to said adjustment plane for said tubular water outlet.

21. The rotatable hydrotherapy jet of claim 20, said mutually engaging means comprising a recessed track along said ball portion and a tab that extends from said socket into said track.

22. The rotatable hydrotherapy jet of claim 21, said track including a series of detents, and said tab being stiffly flexible to ride over said detents during adjustment of the eyeball-type outlet, and to lodge between detents at the conclusion of an adjustment to retain the outlet nozzle at its adjusted position.

23. The rotatable hydrotherapy jet of claim 15, said outlet nozzle comprising a straight tubular nozzle.

24. A rotatable hydrotherapy jet, comprising:

a jet housing, a water inlet into said housing, a water nozzle within said housing for forming water flowing through said inlet into a jet along a water nozzle axis, an outlet nozzle having an outlet nozzle axis, a support structure that is mounted to and rotatable relative to said housing for holding said outlet nozzle downstream from said water nozzle to receive said jet, with the outlet nozzle axis offset from and at a non-intersecting and non-parallel orientation with respect to the water nozzle axis, such that the flow of said jet through the outlet nozzle at said non-intersecting and non-parallel orientation imparts a turning moment to said support structure, causing it to rotate along with said outlet nozzle, and means for introducing an air flow into said water jet between said water and outlet nozzles.

25. A rotatable hydrotherapy jet, comprising:

a jet housing, a water inlet into said housing, a water nozzle within said housing for forming water flowing through said inlet into a jet along a water nozzle axis, an outlet nozzle having an outlet nozzle axis, and a support structure that is mounted to and rotatable relative to said housing for holding said outlet nozzle downstream from said water nozzle to receive said jet, with the outlet nozzle axis offset from and at a non-intersecting and non-parallel orientation with respect to the water nozzle axis, such that the flow of said jet through the outlet nozzle at said non-intersecting and non-parallel orientation imparts a turning moment to said support structure, causing it to rotate along with said outlet nozzle, said housing including a cavity for receiving said support structure, said cavity including a cylindrical stator extending up from its base with an opening through the stator for said water jet, with said support structure rotatably mounted to said stator.

26. The rotatably hydrotherapy jet of claim 25, further comprising a ball bearing track between said stator and said support structure.

* * * * *